US006685170B1

(12) United States Patent
Gwynn

(10) Patent No.: US 6,685,170 B1
(45) Date of Patent: Feb. 3, 2004

(54) TOILET REMOVAL AND TRANSPORTATION APPARATUS

(76) Inventor: Russell E. Gwynn, 21 Panorama La., Cody, WY (US) 82414

( * ) Notice: Subject to any disclaimer, the term of this patent is extended or adjusted under 35 U.S.C. 154(b) by 79 days.

(21) Appl. No.: 09/922,870

(22) Filed: Aug. 6, 2001

(51) Int. Cl.[7] ..... B66D 1/36

(52) U.S. Cl. ..... 254/325; 254/334; 269/17; 29/281.4

(58) Field of Search ..... 254/324, 325, 254/334; 269/17; 29/281.4

(56) References Cited

U.S. PATENT DOCUMENTS

| | | | | | |
|---|---|---|---|---|---|
| 209,519 | A | * | 10/1878 | Sands | 5/86.1 |
| 698,338 | A | * | 4/1902 | Taylor | 254/324 |
| 1,030,765 | A | * | 6/1912 | Bean | 254/325 |
| 1,214,104 | A | * | 1/1917 | Wingire | 254/334 |
| 1,915,900 | A | * | 6/1933 | Moody | 254/334 |
| 2,937,850 | A | | 5/1960 | Winkler et al. | 254/8 |
| 3,391,905 | A | | 7/1968 | Burns | 254/7 |
| 4,084,706 | A | | 4/1978 | Russell | 214/1 D |
| 4,239,443 | A | | 12/1980 | Rysewyk | 414/618 |
| 4,491,452 | A | | 1/1985 | Matovich | 414/427 |
| 4,671,731 | A | | 6/1987 | Harlan | 414/550 |
| 4,722,511 | A | | 2/1988 | Chitwood | 254/7 |
| 5,184,653 | A | | 2/1993 | Lacy | 141/98 |
| 5,203,065 | A | | 4/1993 | Peters | 29/281.4 |
| 5,263,687 | A | * | 11/1993 | Garbiso | 254/334 |
| 5,265,834 | A | * | 11/1993 | Daniels | 248/104 |
| 5,505,430 | A | | 4/1996 | Barnett | 254/2 |
| 5,511,256 | A | * | 4/1996 | Capaldi | 5/83.1 |
| 5,556,076 | A | | 9/1996 | Jacquay | 254/8 |
| 5,738,046 | A | * | 4/1998 | Williams et al. | 119/770 |
| 5,772,183 | A | * | 6/1998 | Sears | 269/228 |
| 5,897,104 | A | * | 4/1999 | Garbiso | 254/334 |
| 6,015,137 | A | | 1/2000 | Guevara et al. | 254/323 |
| 6,164,625 | A | | 12/2000 | Shockley et al. | 254/8 |
| 6,464,208 | B1 | * | 10/2002 | Smith | 254/324 |

* cited by examiner

*Primary Examiner*—Emmanuel Marcelo
(74) *Attorney, Agent, or Firm*—Dorsey & Whitney LLP; Shane P. Coleman

(57) ABSTRACT

A collapsible apparatus is disclosed for lifting and transporting objects, such as toilets and similar plumbing fixtures. The toilet lifter has a support structure and a strap system attached thereto. The support structure has three vertical legs with wheels on the bottoms and horizontal support structures connecting the legs at the tops. The strap system includes a loop strap that engages a bowl of the toilet and rear straps that engage a back or middle portion of the toilet. The strap system is supported by the support structure above the toilet in use and passes across a pivot point on the support structure to raise and lower the toilet. The straps are connected to a toilet, and the strap system is retracted to lift the toilet. The support structure may be locked into a folded position for transportation.

30 Claims, 13 Drawing Sheets

100

1
2
3
4
5
6
7
8
9
10
11
12
13
14
15
16
17
18
19
20
21
22
23
24

100

1
2
12
3
12
11
10
21
8
20
7
13
13
21
18
19
15
16
17
5
11
10
36"
3 3/4"

100
130

Tank
17
15
Seat
16
Bowl
Seat
Connector

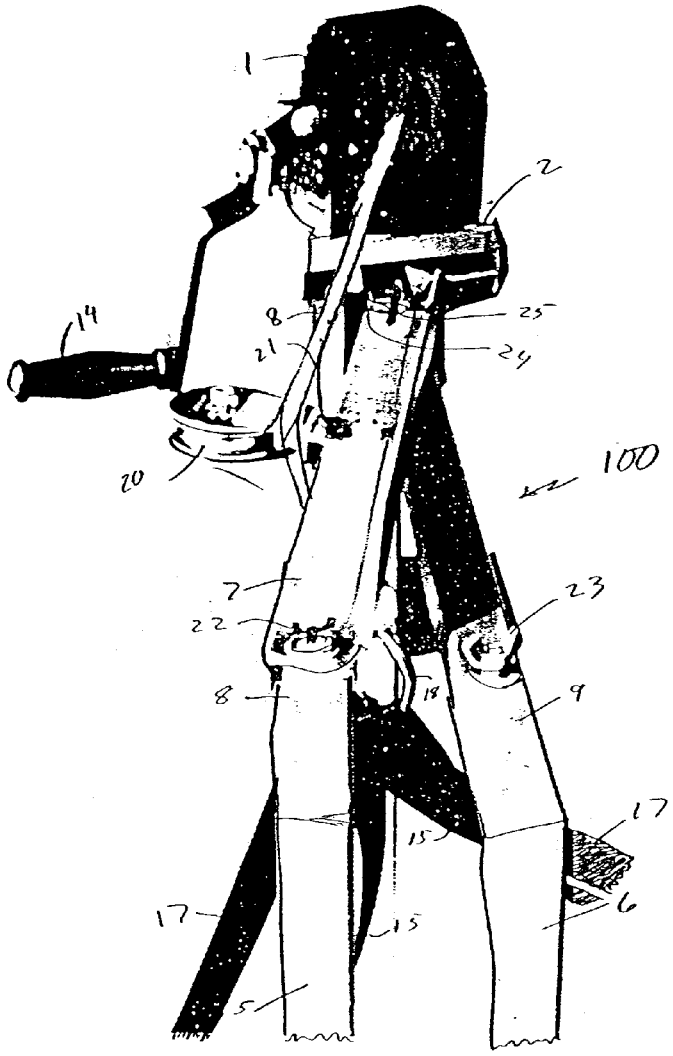
Fig. 13
Fig. 14
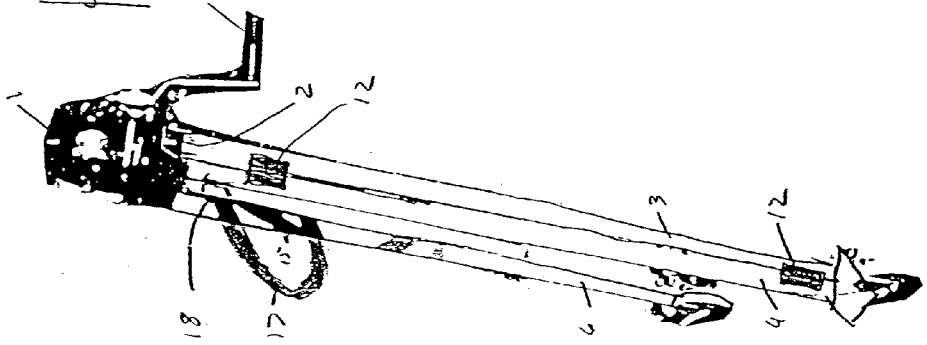

7
22
20
24
23

TOILET REMOVAL AND TRANSPORTATION APPARATUS

FIELD OF INVENTION

The invention relates generally to mobile or traversing hoists. More particularly, it relates to a hand truck and lift for removing and transporting a toilet from an installed position, and for installing a toilet by lowering it into position.

BACKGROUND

In various fields, such as construction, plumbing, and floor covering installation, workers are required from time-to-time to remove toilets or similar fixtures. For example, a plumber may need to remove an existing toilet to perform work on the drain pipes. A floor covering installer may need to remove a toilet to lay tile or other floor covering in a bathroom. Upon completion of the job, the worker may then need to replace and reset the toilet.

Toilets are commonly removed simply by the worker standing over the toilet and pulling it up manually from the floor. This is a dangerous task because toilets may be heavy and awkward to handle. The worker can easily suffer personal injuries, such as back injuries, from lifting such a heavy object in such an awkward position. Also, the difficulty removing toilets manually may cause damage to the toilet or to other bathroom fixtures or walls, such as chips or scratches to the toilet tank if it brushes against other items in the bathroom. Also, it may be difficult to completely drain a toilet, and moving it may cause water to spill. It is therefore desirable to use a mechanical apparatus to lift and transport the toilet carefully, and preferably to replace the toilet upon completion of the job. Various hand trucks and lifts are designed to remove and transport toilets. Some systems exert a pushing force upwardly on the toilet. Others exert a pulling force using, for example, straps or a carriage system that engage a portion of the toilet and urge the toilet upward using a hand crank, a jack, or a screw system.

Existing systems fail to meet workers' needs in many respects. Existing systems are too large or cumbersome to use within the confines of smaller bathrooms or smaller doorways, such as those frequently found in older homes. Existing systems are too large and cumbersome to efficiently store or carry, for example in a workers' truck or van. Some existing systems connect to the toilet using complicated systems that require various adjustments and cannot easily engage and disengage certain toilet models. Existing systems also do not protect the toilet from damage during use. What is needed is a compact and efficient hoist for removing, setting, and transporting toilets.

SUMMARY OF INVENTION

An apparatus is disclosed for lifting and transporting objects, such as toilets and similar plumbing fixtures. The apparatus has a support structure and a strap system attached to the support structure. The strap system raises and lowers a toilet bowl when in use. The support structure has three vertical legs including a rear vertical member positioned near the front, center portion of the toilet bowl when in use, and left and right forward vertical members that are positioned on opposite sides of the toilet when in use. The strap system includes a loop strap that engages the bowl of the toilet and rear straps that engage a back or middle portion of the toilet, such as a portion between the bowl and the tank. The strap system passes across a pivot point on the support structure positioned above the toilet, when in use. The loop strap and rear straps are connected to a toilet, and the strap system is retracted by a lift, such as a hand-crank winch, connected to the support structure. The apparatus lifts the toilet off of the ground or other surface and allows it to be moved using wheels attached to the bottom ends of the vertical members.

The support structure has horizontal members that connect the top portions of the front vertical members with the central vertical member. A crossover bar releaseably connects the left horizontal member to the right horizontal member and holds the pivot point, such as a pulley, for the strap system.

In one embodiment the apparatus is collapsible for convenient storage. The left and right support frames of the support structure may be hingedly connected proximate the rear leg. For example, the rear leg may comprise two vertical supports hingedly connected. The crossover bar may be pivotally coupled to one of the horizontal members and releaseably coupled to the other horizontal member. When the crossover bar is released from the releaseably coupled member, the left and right support structures may move nearer each other by pivoting at the central vertical member hinges. In one embodiment, the crossover bar releaseably attaches to a second, locked position of the releaseably coupled member to lock the apparatus in a folded position.

SUMMARY OF DRAWINGS

FIG. 13 shows a view of the top portion of the apparatus in a folded position.

FIG. 14 shows another view of the apparatus in a folded position.

DETAILED DESCRIPTION

Figure 1:
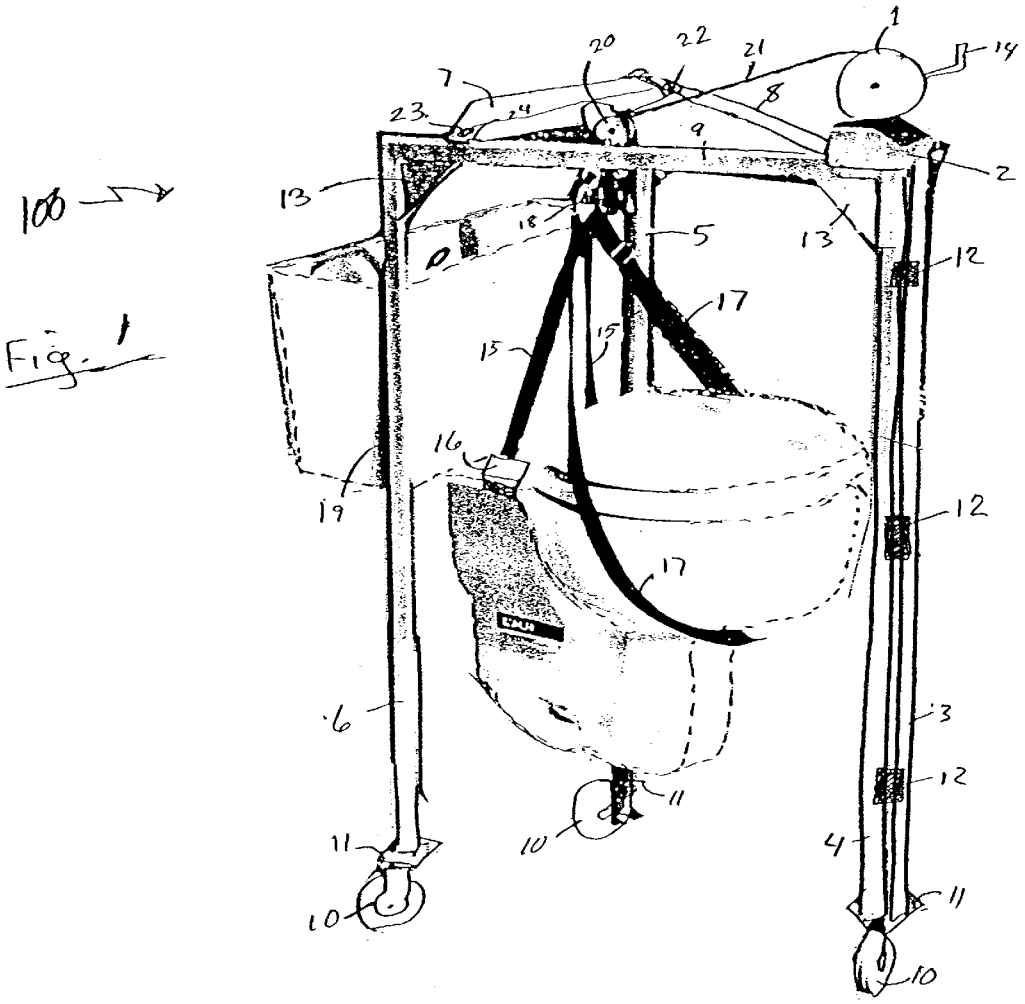
FIG. 1 shows a perspective view of the apparatus in use lifting a toilet.

FIG. 1 shows a perspective view of the apparatus 100 in use on a toilet. The apparatus 100 includes a support structure and strap system. The support structure comprises three legs, including a rear leg and two forward legs, two horizontal supports connecting the rear leg to the forward legs, and a crossover bar connecting the horizontal supports. In the embodiment of FIG. 1, the support structure comprises two substantially similar side support frames, each comprising a rear vertical member 3, 4, a horizontal member 8, 9, and a forward vertical member 5, 6. The rear vertical members may be attached to each other to form a rear leg. In the embodiment shown, the rear vertical members 3, 4 are attached by hinges 12 or other connectors 12 that allow the sides support frames to pivot relative to each other.

In the example of FIG. 1, the rear leg of the support structure includes rear vertical members 3, 4. The rear vertical members 3, 4 are attached to a horizontal members 8, 9 which are in turn attached to forward vertical members 5, 6 that form the forward legs. The vertical and horizontal members 3, 4, 5, 6, 8, 9 may be constructed of a metal tubing, such as a lightweight steel tubing or an aluminum tubing for easy transport. In one embodiment, 1"×1"×0.065" steel tubing is used. In the example shown in FIG. 1, the rear and forward vertical members 3–6 are attached to the horizontal members 8, 9 at the members' respective ends, and corner supports 13 are used to provide further support. The support frame also includes rollers 10, such as wheels, attached to the bottoms of the vertical members 3–6 by casters 11.

In use, the forward vertical members 5, 6 may contact a tank or other portion of the toilet being removed. In the example of FIG. 1, a tank pad 19 is attached along the length of the forward vertical members 5, 6 facing the sides of the members 5, 6 that engage the tank. The tank pad 19 may be a soft material such as a foam or a rubber so the support structure may engage a toilet tank without scratching it and may help hold the tank in place when lifted. In the example shown in FIG. 1, the tank pad 19 runs along the length of the forward vertical member 5. In other embodiments, one or more tank pads 19 may be positioned along the vertical member 5 as desired.

A crossover bar 7 connects the horizontal members 8, 9 of the first and second sides. A pivot point 20, such as a pulley, is attached to the crossover bar 7 near a center point of the crossover bar 7. The pivot point 20 positions a strap system over a toilet when in use. In the example shown in FIG. 1, the strap system comprises a primary strap 21 adapted for engaging the pivot point 20. The primary strap 21 is connected to a loop strap 17 adapted for wrapping around the outside of a front portion of a toilet bowl. The primary strap 21 is also connected to two rear straps 15, each having a lifting hook 16. The lifting hook 16 may be, for example, a metal hook that engages a middle portion of the toilet behind a toilet seat and in front of a toilet tank, near that portion of a toilet where a toilet seat may be attached to the toilet unit. In the example of FIG. 1, the primary strap 21 is attached to the rear straps 15 and the loop strap 17 by an O-ring 18. The strap system may be raised or lowered using a lift 1. As used herein, the term "lift" refers to any device capable of raising or lowering the strap system, directly or indirectly, by extending or retracting a strap, such as the primary strap 21. In one embodiment, the lift 1 may comprise a motor or other device for automatically raising or lowering the strap system. In the example shown in FIG. 1 the lift 1 is a hand crank 1 attached to the horizontal members 8, 9 by crank base 2. The lift 1 has a crank handle 14 that extends and retracts the primary strap 21 which causes the strap system to raise or lower.

As shown, the crossover bar 7 is extended in its extended position in which a releasable fastener 23 is used to hold the horizontal members 8, 9 apart so that the apparatus may engage a toilet. The crossover bar 7 has an opening 24 for engaging the releasable fastener 23, and is connected to the other horizontal member 8 by a pivoting fastener 22. The loop strap 17 is positioned underneath the toilet bowl, and the rear straps 15 are connected by hooks 16 to a mid-portion of the toilet. As shown in FIG. 1, the toilet has been raised using the hand crank 1 and may be moved by wheeling the apparatus 100 using its rollers 10. Tank pads 19 prevent the rear vertical members 5, 6 from scratching the tank of the toilet and help hold the tank in position once lifted.

Figure 2:
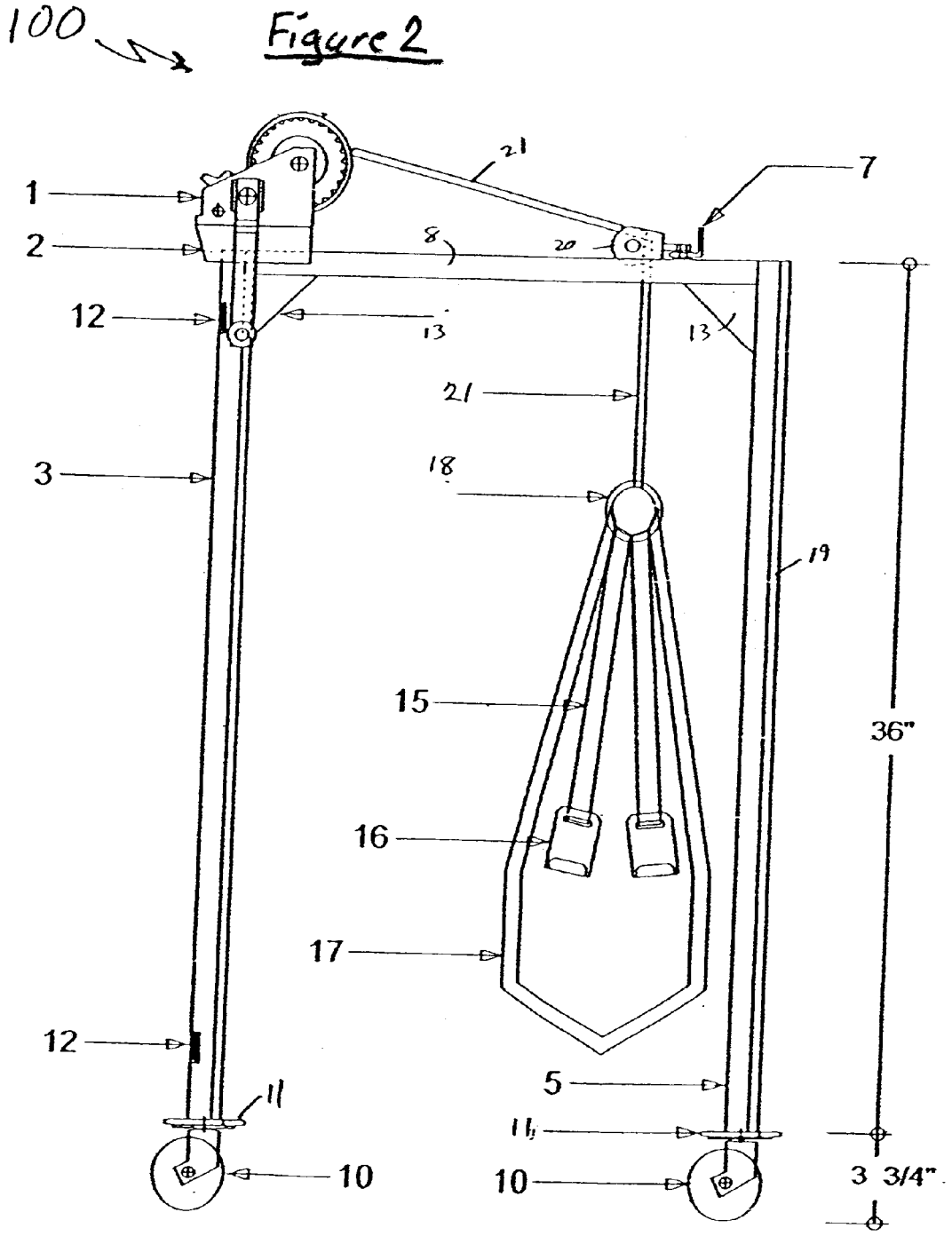
FIG. 2 shows a side view of the apparatus.

FIG. 2 shows a side view of the apparatus 100 showing one of the sides of the support structure having a rear vertical member 3, connected to a horizontal member 8, connected to a forward vertical member 5. In one embodiment, the vertical members 3, 5 are approximately 36 inches long, the horizontal members 8, 9 are approximately 24 inches long, and the crossover bar 7 holds the forward legs 5, 6 approximately nineteen inches apart when extended.

Figure 3:
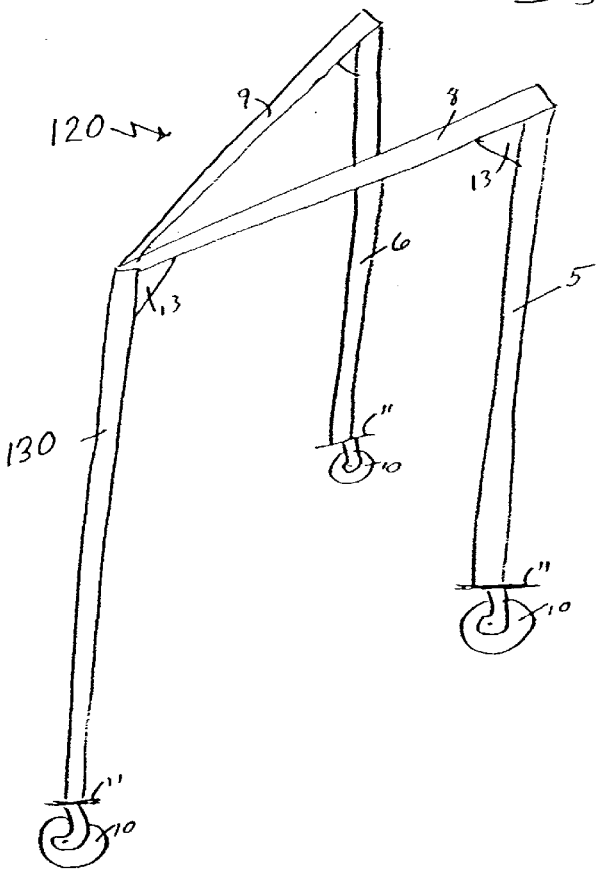
FIG. 3 shows a perspective view of the support structure of the apparatus.

FIG. 3 shows an alternative embodiment of the support structure 120 having three legs 5, 6, 130. In the example of FIG. 3, the rear leg 130 comprises a single vertical member 130 connected to a caster 11 of a wheel 10. The embodiment of FIG. 3 may or may not permit the apparatus to collapse into a folded position.

Figure 4:
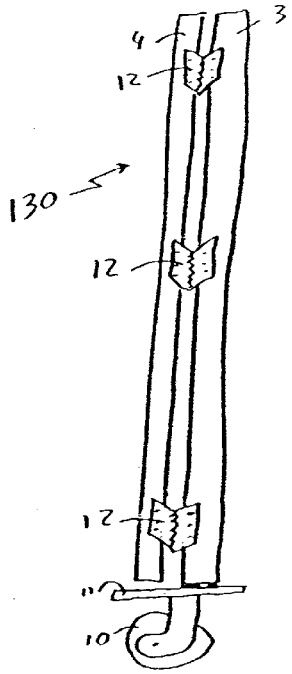
FIG. 4 shows a view of the rear leg apparatus.

FIG. 4 shows another embodiment of the rear leg 130 comprising two rear vertical members 3, 4. The rear vertical members 3, 4 are connected by hinges 12 that permit pivotal movement to allow the apparatus 100 to fold. In the embodiment of FIG. 4, one of the rear vertical members 3 is connected to the caster 11 of the wheel 10, while the other vertical member 4 is not connected to the caster 11 to permit the rear vertical members 3, 4 to move relative to each other.

Figure 5:
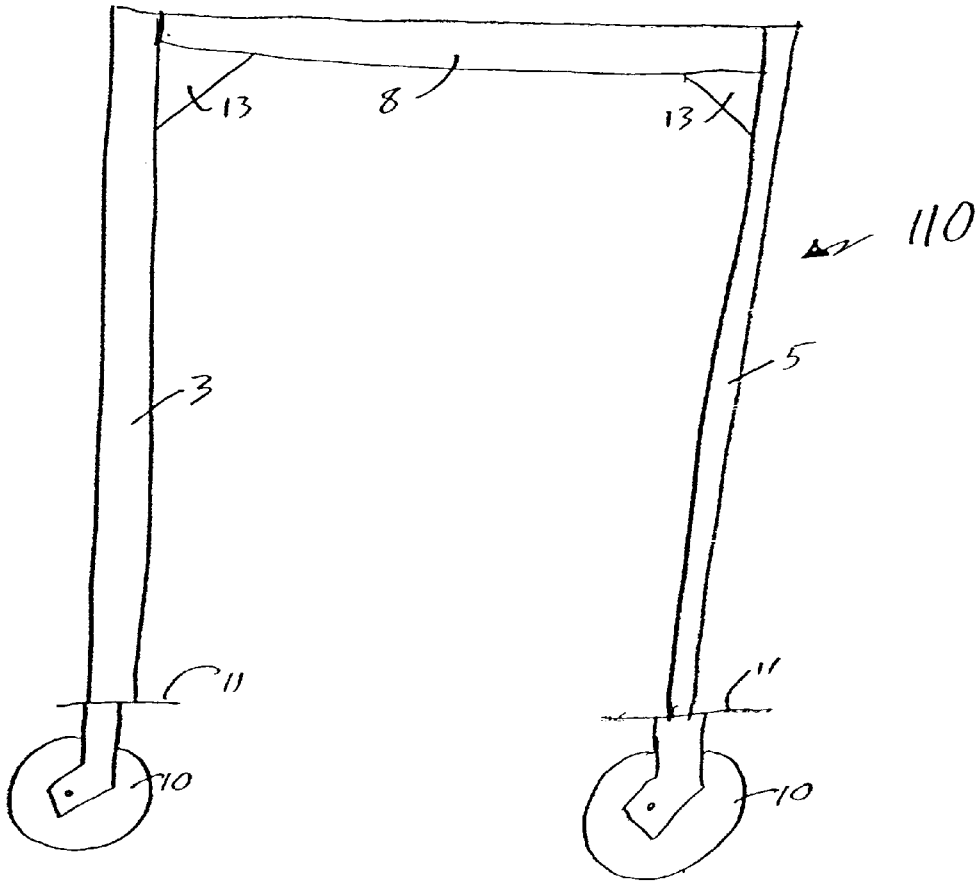
FIG. 5 shows a side view of a support frame of the apparatus.

FIG. 5 shows an example of a side support frame 110 comprising a rear vertical member 3, connected to a horizontal member 8, connected to a forward vertical member 5. In the example of FIG. 5, the horizontal member 8 is fixedly connected to the vertical members 3, 5 and is connected by corner supports 13. In the embodiment of FIG. 5, the apparatus 100 may be formed from two side support frames 110, and the rear leg 130 may be formed from two rear vertical members 3, 4 of two side support frames 110. In other embodiments, a single vertical member 3 may form the rear leg 130. With respect to such embodiments, the term "side support frame" 110 refers to a rear vertical member 3, a horizontal member 8, and a forward vertical member 5 where a single rear vertical member 3 forms a part of two side support frames 110.

Figure 6:
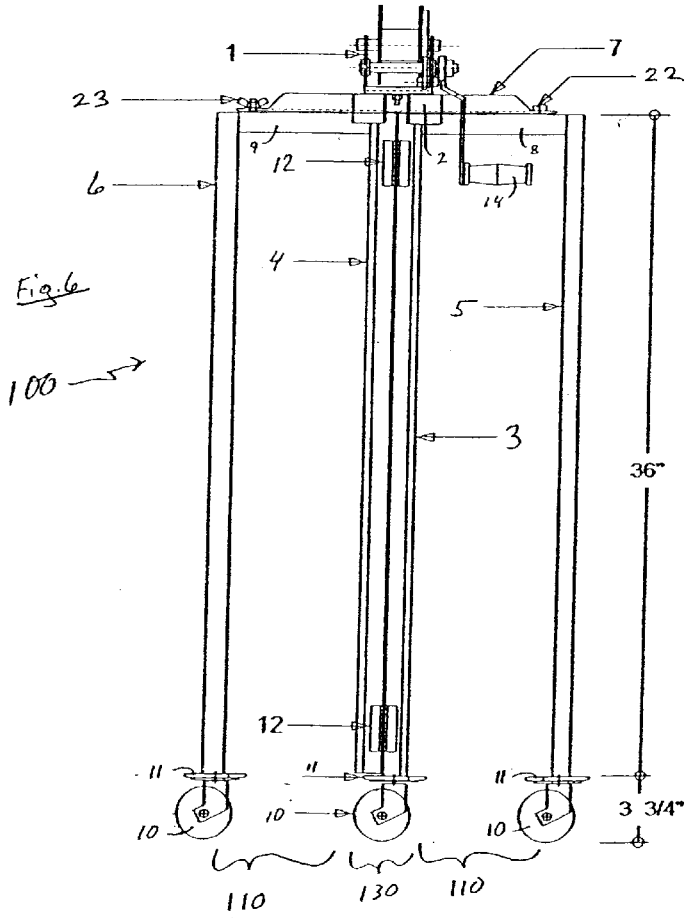
FIG. 6 shows a front view of the apparatus.

FIG. 6 shows a front view of the apparatus 100 showing three legs 5, 6, 130. In the example of FIG. 6, the apparatus comprises two side support frames 110. The right side support frame 110 comprises a rear vertical member 3 connected to a horizontal member 8 which in turn is connected to a forward vertical member 5. The left side support frame 110 likewise includes a rear vertical member 4 connected to a horizontal member 9 which, in turn, is connected to a forward vertical member 6. In the example shown in FIG. 6, the rear vertical members 3, 4 of each side support frame are connected to each other by hinges 12 and together form the rear leg 130 connected to a single caster 11 and roller 10. The forward vertical members 5, 6 of each side support frame 110 form the two forward legs 5, 6 in the example of FIG. 6. A crossover bar 7 connects the two horizontal members 8, 9 using, for example, wing nuts 22, 23 or other connectors. The lift 1 is positioned atop the support structure 120 near the rear vertical member and is connected to at least one of the horizontal members 8, 9 by a base 2. The lift 1 includes a handle 14 for extending and retracting the strap system. In the example shown in FIG. 6, hinges 12 allow the side support frames 110 to move relative to each other so that the apparatus 100 may be folded for convenience. In this embodiment, the fasteners 22, 23 include at least one releasable fastener 23, such as a wing nut 23, which enables the crossover bar 7 to quickly be removed from, or adjusted relative to, one of the horizontal support members 9 so the apparatus 100 may be folded.

Figure 7:
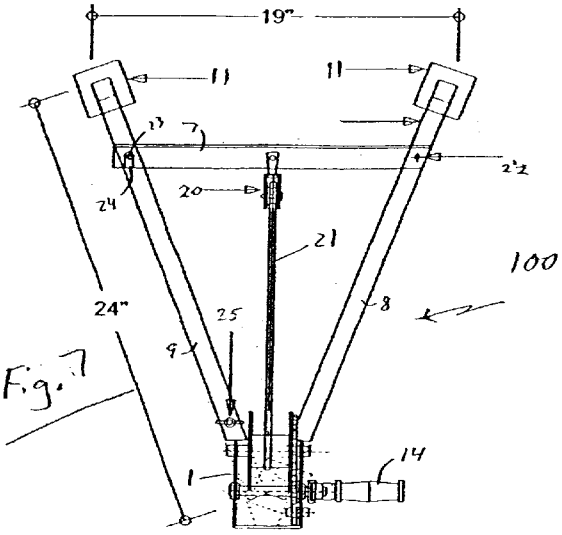
FIG. 7 shows a top view of the apparatus.

FIG. 7 shows a top view of the apparatus 100. As shown, the crossover bar 7 is pivotally connected by a pivotal connector 22 to the right horizontal member 8 and is releasably connected to the left horizontal member 9 by a wing nut 23. An opening 24 in the crossover bar 7 near the wing nut 23 permits the crossover bar 7 to be removed from the releasable fastener 23 when the releasable fastener 23 is loosened. In other embodiments, the side support frames 110 may be moved relative to each other without completely removing the crossover bar 7 from one of the horizontal members 9. For example, the crossover bar 7 may be loosened from its connection on one of the horizontal members 9 and slid relative to the horizontal support 9 using a slot (not shown) in the crossover bar 7.

In the example of FIG. 7, a folded-position fastener 25 is also positioned on the left horizontal member 9 nearer the lift 1. When the apparatus 100 is folded, for example for transportation, the forward releasable fastener 23 is loosened, the crossover bar 7 is pivoted about its pivotal connection 22 to the right horizontal member 8, and the crossover bar 7 engages the folded-position fastener 25. This allows the left horizontal member 9 to fold inwardly toward the right horizontal member 8, and the folded-position fastener 25 locks the apparatus 100 in a folded position. As also shown in FIG. 7, when in use, the primary strap 21 is extended and retracted by the lift 1 and passes over the pivot point 20, such as a pulley 20, which may be positioned near a center point of the crossover member 7.

Figure 8:
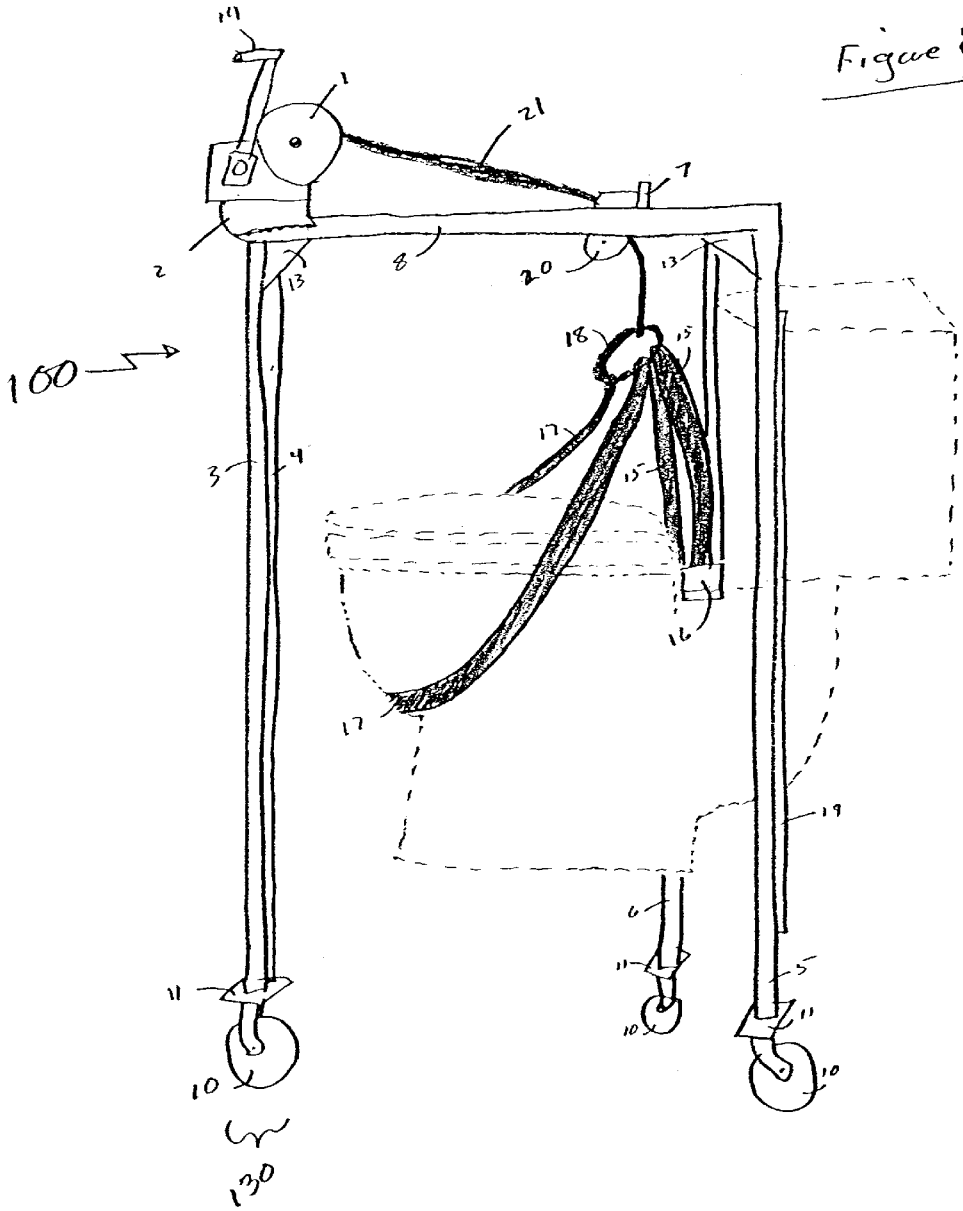
FIG. 8 shows a side view of the apparatus lifting a toilet.

FIG. 8 shows a side view of the apparatus 100 in use, engaging a toilet. In the example of FIG. 8, the toilet has been engaged by the strap system and has been lifted from the ground using the lift 1. The support structure 120 has three legs 5, 6, 130. The rear leg 130 comprising the rear vertical members 3, 4 of each side support frame 110 is positioned near the front center of the toilet when in use. The forward legs 5, 6, in this case the forward vertical members 5, 6 of the side support frames 110, pass alongside the toilet as the apparatus 100, engages the toilet. The forward legs 5, 6 include tank pads 19, and the forward vertical members 5, 6 are positioned adjacent to the forward portion of the toilet tank such that the tank pad 19 engages the tank when in use.

The loop strap 17 is positioned around the toilet bowl, and the rear straps. 15 are connected via connecting hooks 16 to a mid-portion of the toilet behind the bowl and in front of the tank. When the loop strap 17 and the rear strap 15 are positioned on the toilet, the lift 1 retracts the primary strap 21 creating tension on the loop strap 17 and the rear straps 15. The tension causes the straps 15, 17 to hold the toilet and further retraction of the primary strap 21 causes the strap system to raise and the toilet to lift. Once the toilet is lifted, it may be moved by rolling the apparatus 100 using the wheels 10. The toilet may then be repositioned by lowering the strap system and removing the straps 17, 15. The loop strap 17 and the rear straps 15 in one embodiment have relative lengths that help to hold the tank substantially upright as it is lifted. The lift 1 may include a locking mechanism that locks the strap system in place to hold the toilet in place once raised from the ground. To replace the toilet, the user positions the toilet over the drain, releases the lock, and slowly extends the primary strap 21.

Figure 9:
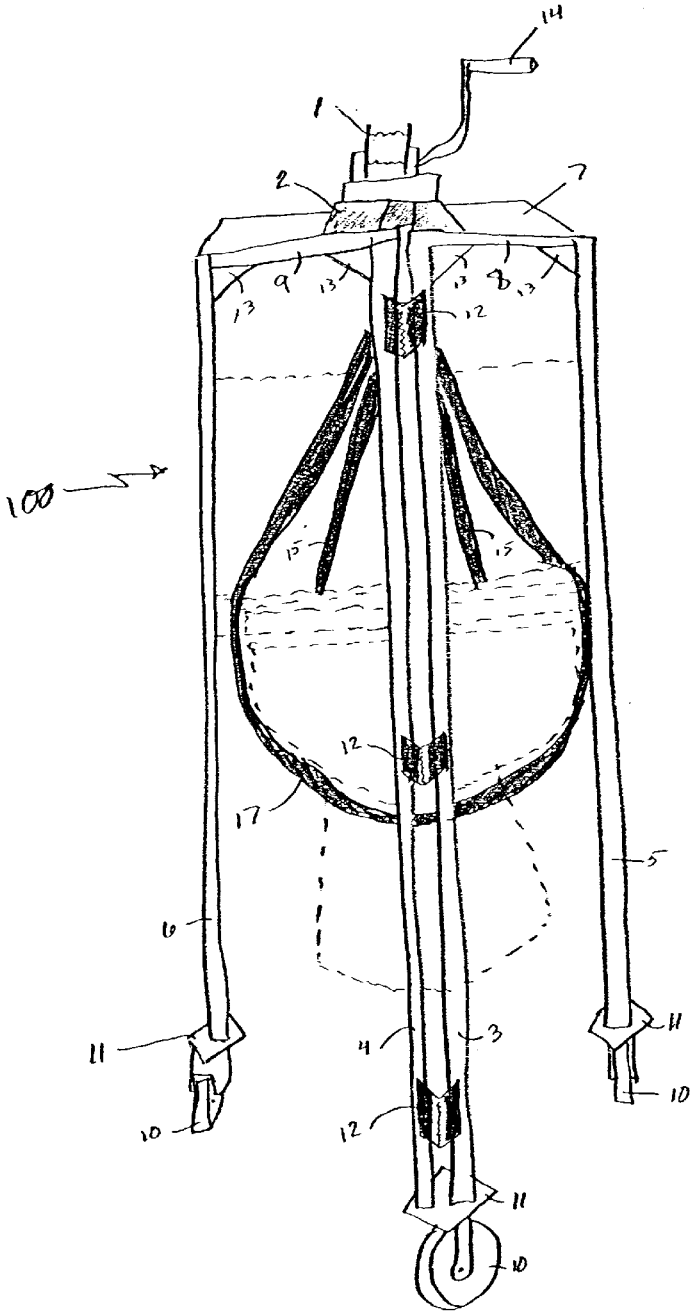
FIG. 9 shows a front view of the apparatus lifting a toilet.

FIG. 9 shows a front view of the apparatus 100 as shown in FIG. 7. In the embodiment shown in FIG. 8, the rear leg 130 comprises the rear vertical members 3, 4 of the left and right side support frames 110. Forward vertical members 5, 6 of each of the side support frames 110 engage the tank near the outside edges of the tank and the apparatus 100 in its extended position is not substantially wider than the tank itself.

Figure 10:
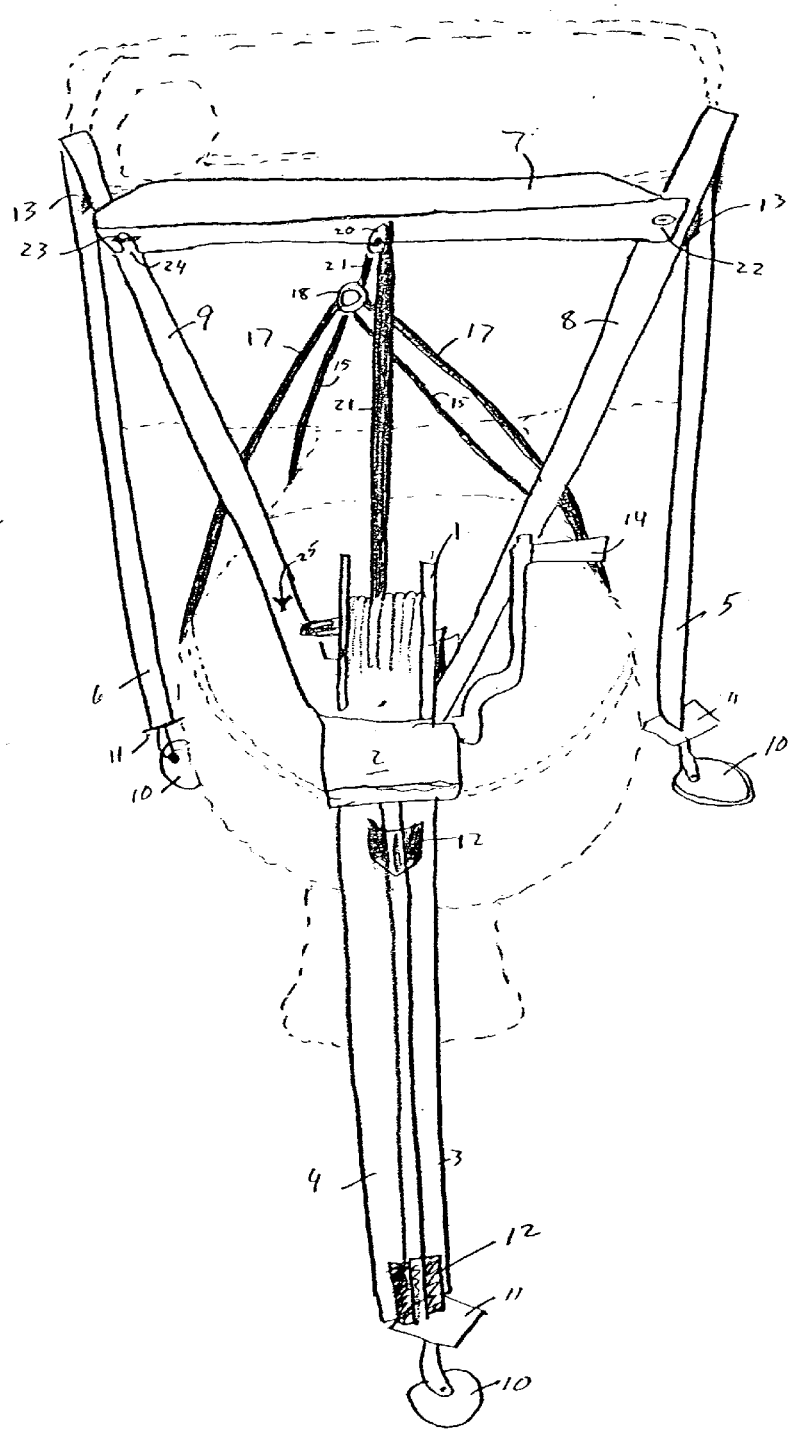
FIG. 10 shows a perspective view of the apparatus lifting a toilet.

FIG. 10 shows another view of the apparatus 100 shown in FIGS. 7 and 8. The toilet has been lifted by connecting the looping strap 17 around the bowl portion of the toilet and by connecting the rear straps 15 to the mid-portion of the toilet. The tank is positioned adjacent to the forward vertical members 5, 6. The embodiment of FIG. 10 includes a folded-position fastener 25 nearer the rear leg 130 than the extended-position releasable fastener 23.

Figure 11:
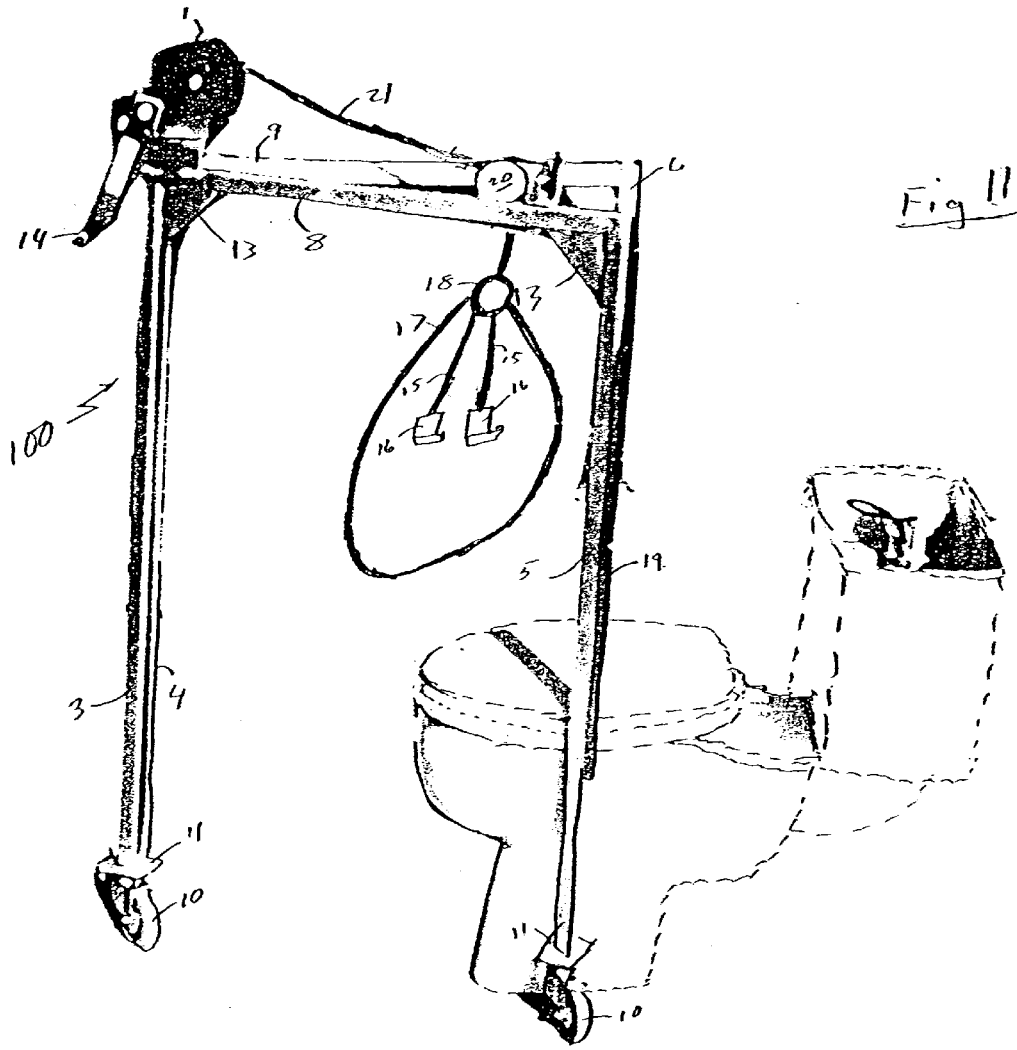
FIG. 11 shows a side view of the apparatus engaging a toilet.

FIG. 11 shows the apparatus 100 as it is about to engage a toilet. The forward legs 5, 6 are positioned on either side of the toilet, and the apparatus 100 is rolled into place with the rear leg 130, consisting of the rear vertical members 3, 4 of each of the side support frames 110, near the front of the toilet. The tank pads 19 are aligned so that they touch the front of the tank as the toilet is engaged. The strap system is lowered to engage the toilet by lowering the primary strap 21 with the lift 1. The loop strap 17 is looped around the front of the toilet bowl, and the rear straps 15 are connected to a mid-portion of the toilet using metal hooks 16. When the straps 15, 17 have engaged the toilet, lift 1 raises the primary strap 21, creating tension in the straps 15, 17, 21 causing the toilet to lift. The toilet may then be moved by wheeling the apparatus 100 using its wheels 10.

Figure 12:
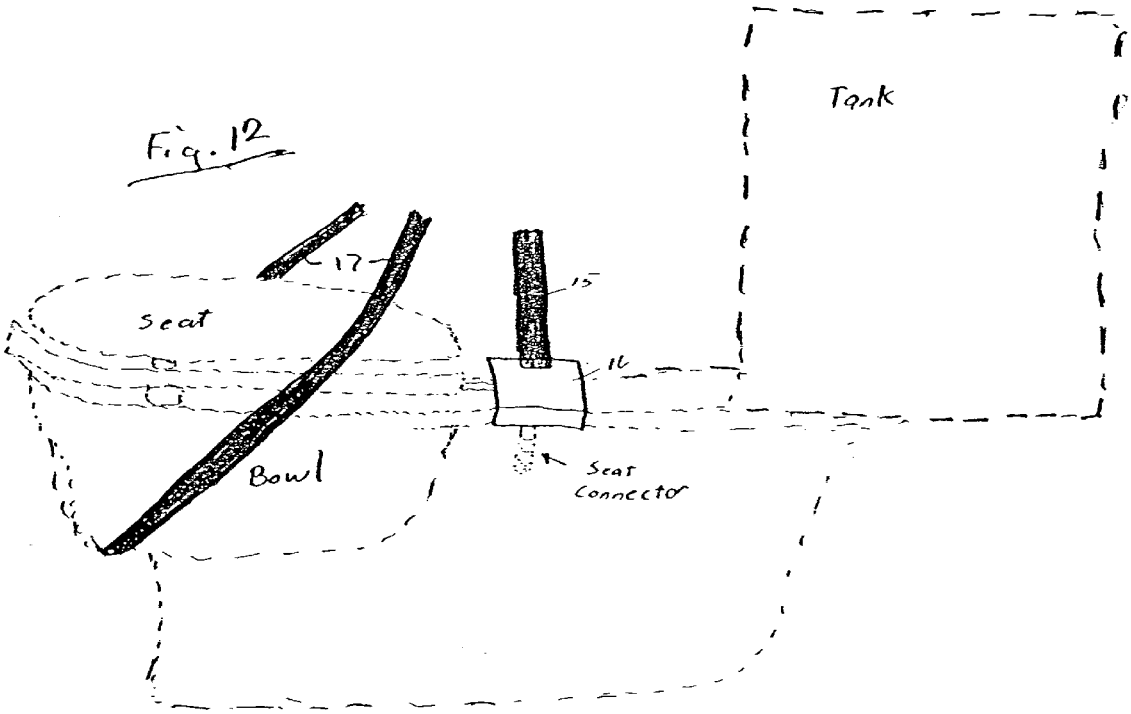
FIG. 12 shows a view of the strap system engaging a toilet.

FIG. 12 shows a more detailed diagram of the strap system engaging the toilet. As shown in FIG. 12, the loop strap 17 loops around the bowl, and the rear straps 15 engage a mid-portion of the toilet using lifting hooks 16. In the embodiment shown in FIG. 12, the rear straps 15 engage the toilet near a portion between the toilet seat and the toilet tank. In the embodiment shown in FIG. 12, the lift hook 16 engage the toilet near standard seat connectors that connect the toilet seat to the toilet. The toilet may be removed without removing the seat in one embodiment. One skilled in the art will recognize that the rear straps 15 may engage various portions of the toilet (or other fixture that is being lifted) and may use various types of hooks 16 for engaging the toilet, or may use no hooks at all.

FIG. 13 shows the apparatus 100 in a folded position. The extended-position releasable forward fastener 23 has been loosened to enable the crossover bar 7 to disengage from its extended position via its opening 24. The opening 24 then engages a folded-position releasable fastener 25 nearer the lift 1 and rear leg 130. In the folded position, the horizontal members 8, 9 are positioned closer to each other to make the apparatus 100 more compact, for example for travel or storage. In the example shown in FIG. 13, the pivot point 20 is a pulley and remains fixedly attached to the crossover bar 7 in the folded position. Also, the strap system, including the primary strap 21, remains connected to the lift 1 and continues to pass near the pivot point 20. In other embodiments, the crossover bar 7 might be completely removed, or the pivot point 20 and the strap system may disengage from the crossover bar 7.

FIG. 14 shows another view of the apparatus 100 in a folded position. As shown, the rear vertical members 3, 4 forming the rear leg 130 have been rotated about their hinges 12 causing the forward vertical members 5, 6 to move closer to each other as shown in FIG. 14.

Figure 15:
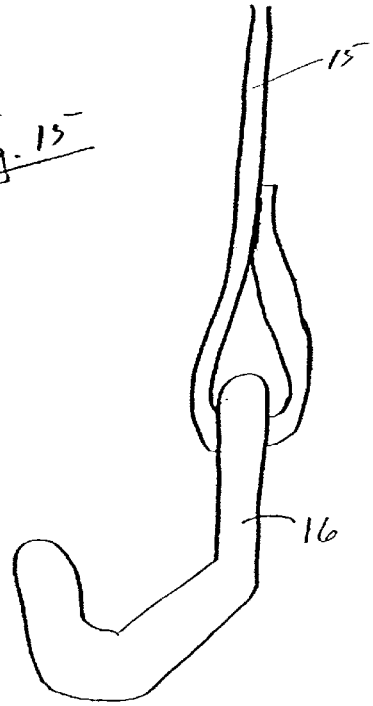
FIG. 15 shows a view of a rear strap.
Figure 16:
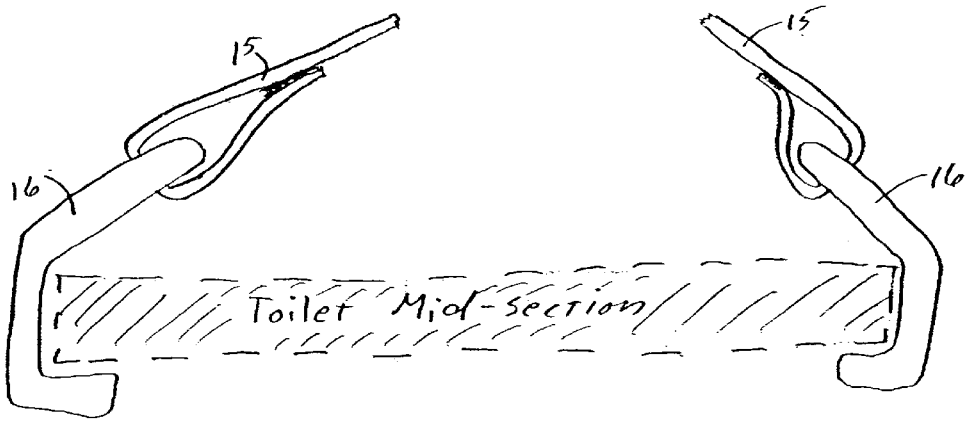
FIG. 16 shows a view of rear straps engaging a middle portion of a toilet.

FIG. 15 shows a more detailed diagram of the rear strap 15 and hook 16. In the embodiment shown in FIG. 15, the hook 16 is fixedly attached to the rear strap 15. The hook 16 is suitably formed to engage a portion of a toilet or other fixture. In the example of FIG. 15, the hook is bent to engage a middle section of a toilet. FIG. 16 shows a cross-section of a middle portion of a toilet that has been engaged by the hooks 16 of the rear straps 15.

Figure 17:
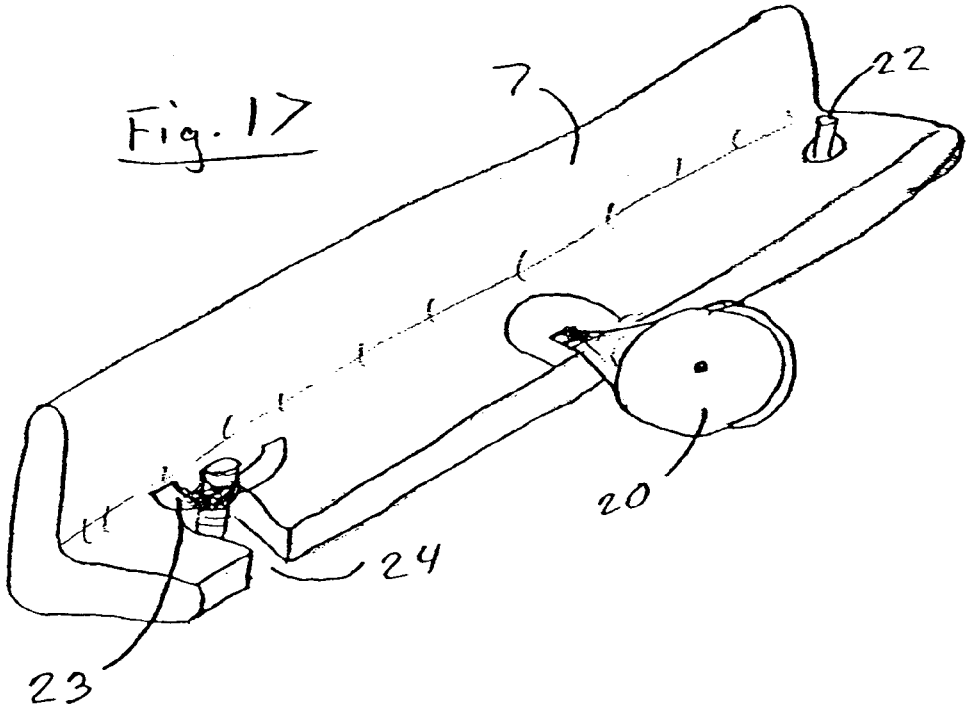
FIG. 17 shows a perspective view of a crossover bar.

FIG. 17 shows a perspective view of a crossover bar 7. In the example of FIG. 17, the crossover member 7 is an angular metal or plastic support member having a pulley 20, or other pivot point 20, disposed proximate its midpoint. The crossover bar 7 has a circular opening at one end that receives a fastener 22 to pivotally attach to one of the horizontal members 8. The other end has an opening 24 to facilitate releasable attachment of the crossover bar 7 to the other horizontal member 9 at a releasable fastener 23. The releasable opening 24 may engage another releasable fastener (25 in FIG. 10) in a folded position, or another suitable fastener may be used to hold the apparatus 100 in a folded position.

In one embodiment, the vertical members 3, 4, 5, 6 each have lengths of approximately three feet, the horizontal members 8, 9 have lengths of approximately two feet, and in extended position, the forward legs 5, 6 are approximately nineteen inches apart. In one embodiment, the vertical members 3, 4, 5, 6 have sufficient lengths to enable the apparatus 100 to lift a toilet high enough (for example, 6–18 inches) so that the toilet fitting can be accessed quickly, without removing the toilet from the bathroom. For example, a toilet may be lifted from its fitting and held in a locked position above the drain while a user performs minor work on the drain pipe. When the user is done, the toilet is lowered back into position and set. In one embodiment, the rollers 10 may be wheels having diameters of approximately three to six inches and are adapted to traverse rough or bumpy ground surfaces, such as seams between different types of flooring, construction sites, or outdoor terrain, without tipping the apparatus 100. In one embodiment, the rollers 10 are made from a solid material; in another embodiment, the roller 10 are made from an outer rubber material filled with air to enable the apparatus 100 to move more smoothly over rough terrain. The rollers 10 may be swivelly mounted to casters 11 and may be designed to prevent marking or scuffing the floor surface when the apparatus 100 is in use. In one embodiment, the apparatus 100 keeps the lifted toilet substantially upright during lifting and transport to enable the toilet to be lifted without draining the toilet and without spilling the toilet water.

One optional implementation of the apparatus 100 includes a drain pan (not shown) or other fluid collection means adapted to connect to the apparatus 100 to collect water dripping or flowing from a lifted toilet. In one embodiment, the vertical members 3, 4, 5, 6 include hooks or other fasteners that engage a drain pan positioned beneath a lifted toilet. In another embodiment, the apparatus may include an overflow reservoir, such as a bucket, connected to the bottom of the toilet by a hose to collect water from the toilet. In embodiment, a cap or similar device may be used to attach to the toilet drain to prevent water from leaking from the toilet once it is removed from its setting.

One embodiment of the apparatus 100 includes additional features to facilitate folding of the apparatus 100. The vertical and/or horizontal members 3, 4, 5, 6, 8, 9 may be telescoping members or otherwise foldable. The vertical members 3, 4, 5, 6 may be pivotally connected to the horizontal members 8, 9, for example by hinges that allow the support structure 120 to fold to a more compact position when not in use. The vertical members 3, 4, 5, 6 may be removably connected to the horizontal members 8, 9, for example to facilitate more compact transportation and storage of the apparatus 100.

In one embodiment, the strap system includes a ⅜" nylon rope as the primary strap 21 and 1" nylon straps as the rear straps 15 and the loop strap 17. The rear straps 15 and/or the loop strap 17 may have adjustable lengths to facilitate engagement of toilets of various shapes and sizes. The adjustable straps 15, 17 may adjust to lengths that allow the strap system to suspend the toilet in a substantially upright position. In one embodiment, the strap system may include straps 15, 17 having lengths, adjustable or otherwise, suitable to engage other plumbing fixtures such as urinals. In some uses such as lifting of a urinal, only the rear straps 15 may be used, while in other implementations only the loop strap 17 may be used. In use in one embodiment, the loop strap 17 and the rear straps 15 lift the toilet substantially upright from the floor surface and keep the toilet in a substantially upright position when lifted. This enables the user to lift a toilet without draining water from it, for example, to perform a minor repair such as a repair to a wax ring or other drain connector or fitting. In one embodiment, the loop strap 17, rear straps 15, and primary strap 21 attach to each other at a junction such as the O-ring 18, positioned above the center of the toilet between the tank and the bowl for a balanced lift. The toilet may be replaced by lowering the toilet in a substantially straight downwardly position. A lift 1 allows the user to lower the toilet slowly while aligning the toilet on the drain fitting, anchoring bolts, or other connections.

In one embodiment, the strap system includes a loop strap 17 and rear straps 15 that are substantially permanently connected to the strap system, for example, by the O-ring 18 shown in FIG. 1 or by a direct connection, such as stitching or using a single strap for both the primary strap 21 and another strap, such as the loop strap 17. In another embodiment, the loop strap 17 and the rear straps 15 may be releasably connected to the strap system, for example to an O-ring 18 or other connector, so that selected straps may be removed from the strap system when not in use. In one embodiment, various other straps may attach, releasably or otherwise, to the strap system to adapt to lift objects of varying shapes and sizes.

Although the present invention has been described with respect to particular embodiments thereof, variations are possible. The present invention may be embodied in specific forms without departing from the essential spirit or attributes thereof. In particular, one skilled in the art will recognize that the apparatus may have various numbers of legs, each of which may comprise one or more elongated members. Also, one skilled in the art will recognize that many types of lifts may be used. It is desired that the embodiments described herein be considered in all respects illustrative and not restrictive and that reference be made to the appended claims and their equivalents for determining the scope of the invention.

I claim:

1. A toilet removal apparatus comprising:

a support structure having:

a rear leg;

a first forward leg;

a first horizontal member connected to the rear leg and to the first forward leg;

a second forward leg;

a second horizontal member connected to the second forward leg and the rear leg;

a crossover bar connected to the first and second horizontal members; and a strap system having:

a primary strap that engages the crossover bar at a pivot point;

a loop strap connected to the primary strap;

a rear strap connected to the primary strap; and a lift adapted for extending and retracting the primary strap, the lift being connected to the support structure.

2. The toilet removal apparatus of claim 1, wherein the rear leg comprises a first rear vertical member pivotally coupled to a second rear vertical member.

3. The toilet removal apparatus of claim 1, wherein the strap system further comprises an O-ring that connects an end of the primary strap to an end of the loop strap and to an end of the rear strap.

4. The toilet removal apparatus of claim 1, wherein the crossover bar is pivotally connected to the first horizontal member and releasably connected to the second horizontal member.

5. The toilet removal apparatus of claim 1, further comprising a hinge that pivotally couples the first horizontal member and first forward leg to the second horizontal member and second forward leg, and wherein the crossover bar is releasably connected to the second horizontal member, whereby the first forward leg may be pivoted about the hinge to a position closer to the second forward leg when the crossover bar is released from the second horizontal member.

6. The toilet removal apparatus of claim 1, wherein the second horizontal member comprises a first releasable fastener adapted for fastening the crossover bar in a first position and a second releasable fastener adapted for fastening the crossover bar in a second position.

7. The toilet removal apparatus of claim 6, wherein first releasable fastener is adapted to connect to a portion of the crossover bar in an extended position, and wherein the second releasable fastener is adapted to connect to the portion of the crossover bar in a folded position.

8. The apparatus of claim 1, further comprising a pulley connected to the crossover bar at the pivot point, wherein the primary strap engages the pulley.

9. A toilet removal apparatus comprising:

a first side support frame;

a second side support frame pivotally connected to the first side support frame, wherein the first and second side support frames form a rear leg, and wherein the first and second side support frames are pivotally connected at the rear leg;

a crossover bar connected to the first and second side support frames; and a strap system that engages the crossover bar, the strap system being adapted for engaging a toilet.

10. The toilet removal apparatus of claim 9, wherein the crossover bar comprises a pivot point that engages the strap system.

11. The toilet removal apparatus of claim 9, wherein the strap system includes a loop strap that wraps around an outside portion of a bowl of the toilet.

12. A toilet removal apparatus comprising:

a strap system having a primary strap having an end;

a loop strap connected to the primary strap, the loop strap being adapted for engaging a bowl portion of a toilet and having an adjustable length, wherein the loop strap has first and second ends that connect to the end of the primary strap; and a rear strap connected to the primary strap, the rear strap being adapted for engaging a middle portion of the toilet, wherein the rear strap has a first end that connects to the end of the primary strap.

13. The toilet removal apparatus of claim 12, wherein the strap system is adapted for lifting a toilet by engaging the toilet with the loop strap and the rear strap and retracting the primary strap, and wherein the rear strap and the loop strap have lengths adapted for keeping a toilet substantially upright when the toilet is lifted.

14. The toilet removal apparatus of claim 12, further comprising a means for retracting and extending the strap system to raise or lower the toilet.

15. The toilet removal apparatus of claim 12, further comprising a support structure engaged by the strap system.

16. The toilet removal apparatus of claim 12, wherein the loop strap has a length that is long enough to wrap around a toilet bowl.

17. The toilet removal apparatus of claim 12, further comprising:

a second rear strap having a first end connected to the end of the primary strap and to the first and second ends of the loop strap; and metal hooks connected to second ends of the rear straps, the metal hooks having flat portions adapted to engage a middle portion of a toilet.

18. A toilet removal apparatus comprising:

a rear leg having a top end and a bottom end;

a first horizontal member having first and second ends, the first end being connected proximate the top end of the rear leg;

a first forward leg having top and bottom ends, the top end being connected proximate the second end of the first horizontal member;

a second horizontal member having first and second ends, the first end being connected proximate the top end of the rear leg;

a second forward leg having top and bottom ends, the top end being connected proximate the second end of the second horizontal member;

crossover bar connected to the first and second horizontal members, the crossover bar having a pivot point;

a primary strap that engages the pivot point;

a lift connected to the primary strap, which lift causes the primary strap to move relative to the pivot point;

a loop strap connected to an end of the primary strap, the loop strap being adapted for looping around an outside portion of a toilet bowl; and a rear strap connected to the end of the primary strap, the rear strap being adapted for engaging a portion of a toilet between the bowl and a tank, wherein when the strap system is connected to a toilet, the lift causes the toilet to move up or down.

19. The apparatus of claim 18, wherein the first horizontal member comprises a pivotal connector that pivotally connects a first end of the crossover bar to the first horizontal member, and wherein the second horizontal member comprises first and second connectors that removably connect a second end of the crossover bar to the second horizontal member, the first connector being located further from the rear leg support member than the second connector, wherein the apparatus is in an extended position when the crossover bar is connected to the first connector and is in a folded position when the crossover bar is connected to the second connector.

20. An apparatus for lifting and transporting toilets and other plumbing fixtures, the apparatus comprising:

a means for engaging an outside portion of a bowl portion of a toilet, the means comprising a loop strap that wraps around the outside portion of the bowl portion;

a means for lifting the toilet by exerting a tension force on the means for engaging the outside portion; and a means for supporting the means for engaging the outside portion, the means for supporting being positioned over the toilet when the toilet is engaged by the means for engaging the outside portion.

21. The apparatus of claim 20, further comprising a means for engaging a middle portion of the toilet, and wherein the means for lifting comprises a means for lifting the toilet by exerting a tension force on the means for engaging the middle portion.

22. The apparatus of claim 21, further comprising a means for moving the toilet relative to a floor surface in a lifted, substantially upright position.

23. The apparatus of claim 20, wherein the means for lifting comprises a means for lifting the toilet in a substantially upright position.

24. The apparatus of claim 20, further comprising a means for collecting liquid from the toilet, said means being positioned beneath the toilet when the toilet is in a lifted position.

25. A toilet removal apparatus comprising:

a first side support frame;

a second side support frame pivotally connected to the first side support frame;

a crossover bar connected to the first and second side support frames, wherein the crossover bar is pivotally connected to the first side support frame and is removably connected to the second side support frame, whereby the apparatus may be used in a folded position or in an extended position; and a strap system that engages the crossover bar, the strap system being adapted for engaging a toilet.

26. The apparatus of claim 25, wherein the first and second side support frames each comprises a horizontal member and a forward leg connected to the horizontal member, and wherein the first and second side support frames share a common rear leg connected to the horizontal members of the first and second side support frames.

27. A toilet removal apparatus comprising:

a strap system comprising a primary strap;

a loop strap connected to the primary strap, the loop strap being adapted for engaging a bowl portion of a toilet; and a rear strap connected to the primary strap, the rear strap being adapted for engaging a middle portion of the toilet; and a support structure engaged by the strap system, the structure comprising a rear leg;

a first forward leg connected to the rear leg; and a second forward leg connected to the rear leg and pivotally connected to the first forward leg, wherein the first and second forward legs may move relative to each other to place the apparatus in a folded position.

28. The toilet removal apparatus of claim 27, wherein the support structure comprises a pivot point engages the strap system, wherein the pivot point may be positioned over the toilet when the apparatus is in use.

29. The apparatus of claim 27, wherein the support structure further comprises a crossover bar adapted for holding the apparatus in an extended position.

30. A toilet removal apparatus comprising:

a first side support frame comprising, a first forward leg; and a first horizontal member connected to the first forward leg;

a first rear vertical member connected to the first horizontal member; and a second side support frame pivotally connected to the first side support frame, the second side support frame comprising a second forward leg; and a second horizontal member connected to the second forward leg; and a second rear vertical member connected to the second horizontal member, wherein the first and second rear vertical members form a rear leg and are pivotally connected by a hinge;

a crossover bar connected to the first and second side support frames; and a strap system that engages the crossover bar, the strap system being adapted for engaging a toilet.

* * * * *